US006095705A

United States Patent [19]

Phillips

[11] Patent Number: 6,095,705

[45] Date of Patent: Aug. 1, 2000

[54] FLUID APPLICATOR

[75] Inventor: Gary Phillips, McAllen, Tex.

[73] Assignee: Stuart Entertainment, Inc., Council Bluffs, Iowa

[21] Appl. No.: 09/166,200

[22] Filed: Oct. 5, 1998

[51] Int. Cl.[7] ..... A46B 5/02

[52] U.S. Cl. ..... 401/6; 401/202; D9/338

[58] Field of Search ..... 401/202, 6, 196, 401/198; D9/338, 542, 543, 552

[56] References Cited

U.S. PATENT DOCUMENTS

| | | | |
|---|---|---|---|
| D. 92,534 | 6/1934 | Hale . | |
| D. 161,698 | 1/1951 | Lorenzen . | |
| D. 185,824 | 8/1959 | Armstrong et al. . | |
| D. 189,373 | 11/1960 | Lerner . | |
| D. 194,132 | 11/1962 | Countryman . | |
| D. 202,824 | 11/1965 | Gould . | |
| D. 205,908 | 10/1966 | Sterges | D9/542 |
| D. 215,700 | 10/1969 | Thomson | D9/542 |
| D. 218,148 | 7/1970 | Noyes et al. . | |
| D. 218,221 | 8/1970 | Coghill | D9/542 |
| D. 218,398 | 8/1970 | Coghill | D9/542 |
| D. 220,248 | 3/1971 | Blumenthal . | |
| D. 223,335 | 4/1972 | Donoghue . | |
| D. 223,438 | 4/1972 | Lluch . | |
| D. 225,212 | 11/1972 | de Mandiargues . | |
| D. 234,249 | 2/1975 | Holzaepfel | D9/542 |
| D. 235,032 | 4/1975 | Atkins . | |
| D. 236,432 | 8/1975 | O'Brien | D9/542 |
| D. 240,505 | 7/1976 | Koenigsberg | D9/542 |
| D. 242,225 | 11/1976 | Sinclair . | |
| D. 250,248 | 11/1978 | Grip . | |
| D. 255,653 | 7/1980 | Lipez . | |
| D. 264,811 | 6/1982 | Weckman | D9/542 |
| D. 265,212 | 6/1982 | Spiegel . | |
| D. 274,697 | 7/1984 | Venne . | |
| D. 281,861 | 12/1985 | Jones et al. . | |
| D. 292,672 | 11/1987 | Duell . | |
| D. 292,884 | 11/1987 | Pataki . | |
| D. 293,891 | 1/1988 | Molvik et al. . | |
| D. 294,263 | 2/1988 | Rodgers et al. . | |
| D. 297,915 | 10/1988 | Pataki . | |
| D. 299,471 | 1/1989 | Carver et al. . | |
| D. 300,118 | 3/1989 | Venne et al. | D9/542 |
| D. 303,926 | 10/1989 | Venne et al. . | |
| D. 304,996 | 12/1989 | Hollenberg et al. . | |
| D. 305,300 | 1/1990 | Kraft . | |
| D. 307,444 | 4/1990 | Poisson et al. . | |
| D. 307,919 | 5/1990 | Poisson et al. . | |
| D. 308,476 | 6/1990 | Rosenberg . | |
| D. 308,481 | 6/1990 | Thompson . | |
| D. 310,026 | 8/1990 | Verebelyi . | |
| D. 310,249 | 8/1990 | LaLonde . | |
| D. 310,779 | 9/1990 | Gloeckler | D9/542 |
| D. 312,211 | 11/1990 | Segati | D9/542 |
| D. 314,703 | 2/1991 | Segati . | |
| D. 317,121 | 5/1991 | Crawford et al. . | |
| D. 322,216 | 12/1991 | Zogg et al. . | |
| D. 326,118 | 5/1992 | Black . | |
| D. 333,789 | 3/1993 | Reif . | |
| D. 334,399 | 3/1993 | Ziegler . | |
| D. 337,939 | 8/1993 | Smith, Jr. . | |
| D. 337,948 | 8/1993 | Reif | D9/543 |
| D. 345,376 | 3/1994 | Underwood, Jr. . | |
| D. 347,790 | 6/1994 | Lathrop et al. . | |
| D. 347,791 | 6/1994 | Lathrop et al. . | |
| D. 352,242 | 11/1994 | Crawford et al. . | |

(List continued on next page.)

*Primary Examiner*—David J. Walczak
*Attorney, Agent, or Firm*—Morrison & Foerster LLP

[57] ABSTRACT

This invention relates to a fluid applicator. More particularly, this invention relates to an ink applicator which contains a specially adapted finger support for supporting a user's fingers during fluid application. Preferably, the fluid applicator comprises an applicating end portion having an opening for filling and dispensing fluid from the fluid applicator; a central portion connected to the applicating end portion; a sealed end portion fused to the central portion; and a finger support extending from the applicating end portion transversely throughout the central portion for supporting a user's fingers during fluid application.

5 Claims, 5 Drawing Sheets

U.S. PATENT DOCUMENTS

| | | | |
|---|---|---|---|
| D. 353,051 | 12/1994 | Lonon . | |
| D. 356,505 | 3/1995 | Gonda et al. | D9/542 |
| D. 357,187 | 4/1995 | Sherman | D9/543 X |
| D. 373,143 | 8/1996 | Jagger . | |
| D. 373,537 | 9/1996 | Schirado . | |
| D. 376,697 | 12/1996 | Green et al. | D9/338 X |
| D. 382,479 | 8/1997 | D'Amico et al. | D9/543 X |
| D. 389,865 | 1/1998 | Venne et al. | D9/542 X |
| 843,767 | 2/1907 | Plach . | |
| 1,807,415 | 5/1931 | La France . | |
| 2,996,044 | 8/1961 | Parker . | |
| 3,366,284 | 1/1968 | Marona et al. . | |
| 5,143,463 | 9/1992 | Pozil et al. . | |
| 5,419,592 | 5/1995 | Stuart . | |
| 5,713,681 | 2/1998 | Venne et al. . | |

FLUID APPLICATOR

FIELD OF THE INVENTION

This invention relates to a fluid applicator. More particularly, this invention relates to an ink applicator which contains a specially adapted finger support for supporting a user's fingers during fluid application.

BACKGROUND OF THE INVENTION

Many fluid applicators, particularly ink applicators, have been developed for the purpose of increasing writing comfort. By increasing writing comfort, writing stress can simultaneously be reduced.

Pilot Corporation of America currently has on sale a retractable ball point pen sold under the name Dr. Grip®. The ball point pen is touted to have a therapeutic wide cushion grip which reduces gripping power. The wide cushion grip is also stated to relieve stress and writing fatigue, and has been advertised to be perfect for people with arthritis or carpal tunnel syndrome.

U.S. Pat. No. 5,713,681 discloses an ink marker bottle which is stated to be ergonomically constructed to enable it to be easily held and used. The bottle includes a shoulder portion, a central recessed portion, and a base portion. The central recessed portion of the body merges with the side wall of the shoulder portion at an upper flared surface. This upper flared surface is considered to be arranged to comfortably receive the thumb and index finger of one hand of a person holding the bottle when the bottle is to be held like a pencil or pen and inverted.

The Kiwi Company has currently on sale a polish applicator which is similar to the design of the '681 patent. The Kiwi bottle is made to be inverted in order to apply polish to a shoe, and includes an upper flared surface which can be comfortably received between the thumb and index finger of one hand of a person holding the bottle when it is to be inverted to apply shoe polish to a shoe.

Although many applicators have attempted to overcome the problem of writing stress, as well as providing means by which writing comfort can be increased, means have still not been supplied which are satisfactory for solving the inherent and other associated problems. It is, therefore, desirable to provide fluid applicators having structure that is much more beneficial and geared to a wider variety of uses.

SUMMARY OF THE INVENTION

In order to solve many of the problems inherent in the known devices, there is provided a fluid applicator which comprises an applicating end portion having an opening for filling and dispensing fluid from the fluid applicator; a central portion connected to the applicating end portion; a sealed end portion fused to the central portion; and a finger support extending from the applicating end portion transversely throughout the central portion for supporting a user's fingers during fluid application. An applicator tip may be included within the opening of the applicating end portion. The applicator tip is preferably a roller tip, a daubing tip, a marking tip, or a fountain tip.

In a preferred embodiment, the applicating end portion has a circular shape. The central portion can be an oblong shape. Preferably, the oblong shaped central portion has an oval shape and has a major radius and a minor radius, with the major radius approximating that of the circular shaped applicating end portion, and the minor radius being between 40% and 80% that of the major radius. The finger support can include a convex edge which extends outwardly from the minor radius of the oval shape central portion and terminates at the major radius of the oval shaped central portion.

In another preferred embodiment, the sealed end portion can have a flat, closed end region for standing the fluid applicator at an upright position.

In yet another preferred embodiment, the finger support can extend transversely from the applicating end portion at an angle between 15 and 60 degrees from a plane running horizontally through the applicating end portion and the central portion. Preferably, the finger support terminates at the central portion, and in an alternative arrangement, the finger support can extend in an arcuate, transverse direction through the central portion for supporting a user's fingers during fluid application.

BRIEF DESCRIPTION OF THE DRAWINGS

The present invention will be better understood by reference to the Detailed Description of the Invention when taken together with the attached drawings, wherein.

DETAILED DESCRIPTION OF THE INVENTION

The fluid applicator of this invention can be manufactured from a variety of materials. Plastic-type materials are preferred. Either low density or high density polymer materials can be used. It is highly desirable that the applicator be made of a blow molded plastic composition.

It is contemplated that the fluid applicator of this invention have a variety of uses. For example, the applicator can be used to apply ink to any writing surface, polish to shoes, paint to a surface that is to be painted or even to apply glue to a substrate surface. It is particularly desirable to use the applicator as a marking device, more particularly for daubing, as in daubing ink onto Bingo cards.

The use of the applicator will be primarily dictated by the type of applicator tip which is used. A variety of tips are contemplated such as a roller tip, a daubing tip, a marking tip, or a fountain tip.

In order to provide more comfort to the user and reduce writing stress, the fluid applicator of this invention provides a finger support. In general, the finger support extends from a fluid applicating end portion of the fluid applicator transversely through a central portion of the applicator. The finger support can terminate directly at the central portion of the fluid applicator or it may terminate below the central portion of the applicator, which is preferably referred to as the sealed end portion. The finger support is actually a protrusion and has an edge which extends sufficiently outward from the central portion of the fluid applicator so that it is effective as a support member for a user's fingers during fluid application. The support is extended outwardly so that the user's fingers can rest against the support, rather than squeezing it to increase gripping action. Preferably, the finger support is provided on adjacent sides of the fluid applicator and extends in a transverse direction which allows the users thumb and second finger to rest against the support.

Figure 1:
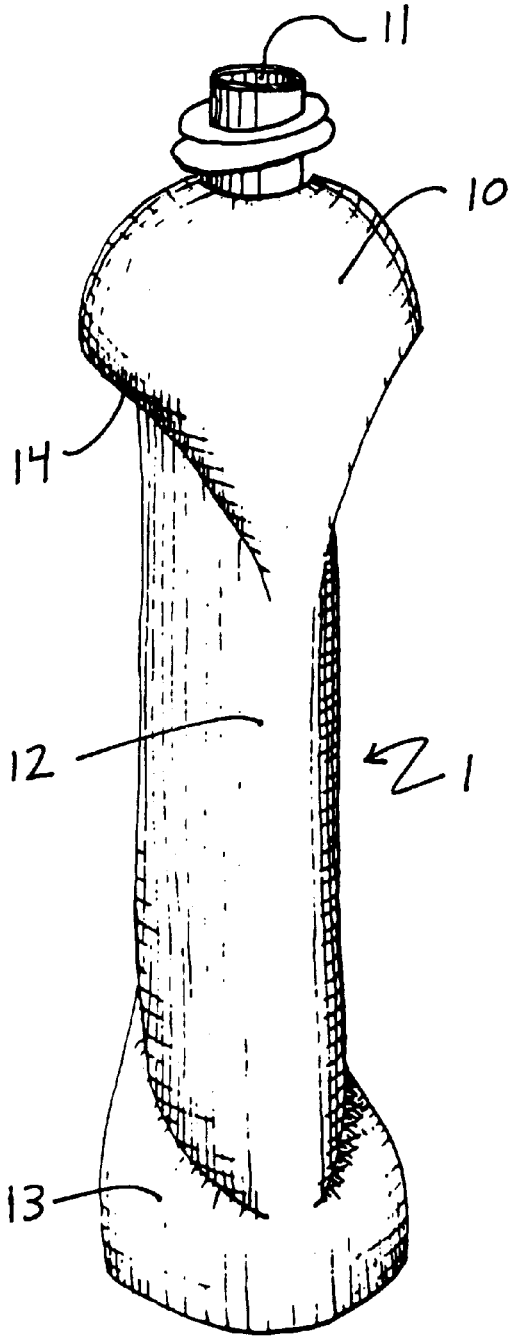
FIG. 1 is an isometric view of a preferred embodiment of the invention.

A preferred embodiment of the invention is shown in FIG. 1 in isometric view. The fluid applicator 1 has an applicating end portion 10, with the applicating end portion having an opening 11 for filling and dispensing fluid from the fluid applicator. The opening is of sufficient diameter to allow fluids of various types to be filled or dispensed from the applicator. Liquid ink or shoe polish is a preferred fluid; however, any liquid having material of a flowing viscosity at room temperature can be used. For example, liquid glue can be used.

The fluid applicator 1 further includes a central portion 12 which is connected to the applicating end portion 10. Fused to the central portion 12 is a sealed end portion 13. Preferably, the applicating end portion 10 has a circular shape, and the central portion 12 has an oblong shape, although different shapes can be used. Preferably, the central portion 12 is an oval form, but the central portion, as well as the entire applicator, can have somewhat squared ends to provide a more rigid structure or to preserve shelf space. Although the sealed end portion 13 is shown as having a flat, closed end region for standing the fluid applicator on one end, a round end can be substituted if desired.

Extending from the applicating end portion 10 is a finger support 14. In this embodiment, the finger support terminates at the central portion 12. However, embodiments are contemplated in which a finger support can extend directly through the central portion 12 and terminate at sealed end 13.

Figure 2:
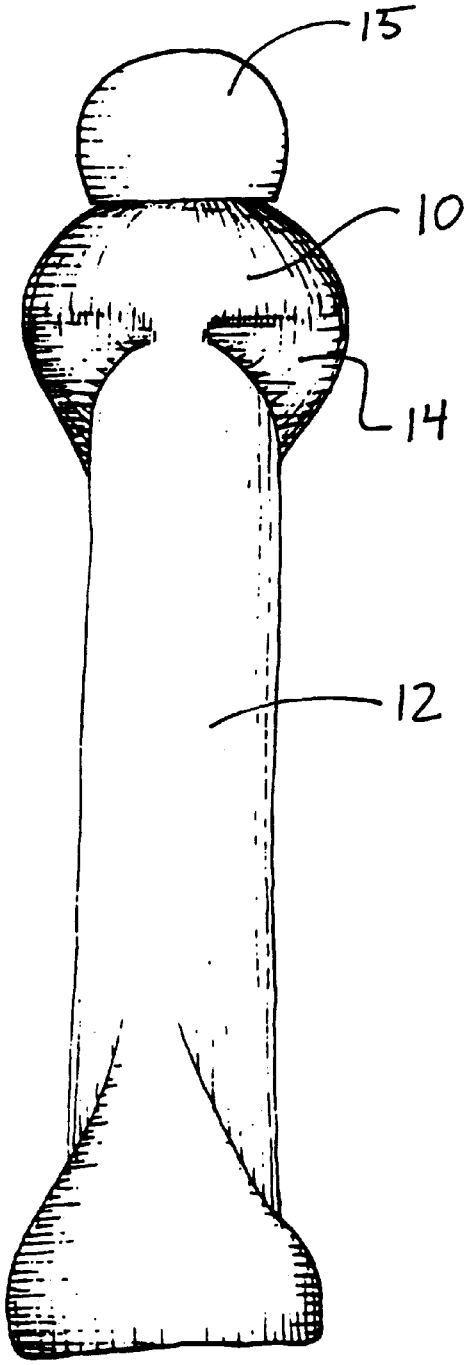
FIG. 2 is a side view of one embodiment of the invention.

FIG. 2 shows another embodiment in which applicating end 10, central portion 12, and finger support 14 are detailed in a side view. In addition, this view shows a top 15 which can be fitted over the opening. The top 15 is preferably a screw top, but can be a snap top or any other type of top which is friction fitted or lock mounted.

Figure 3:
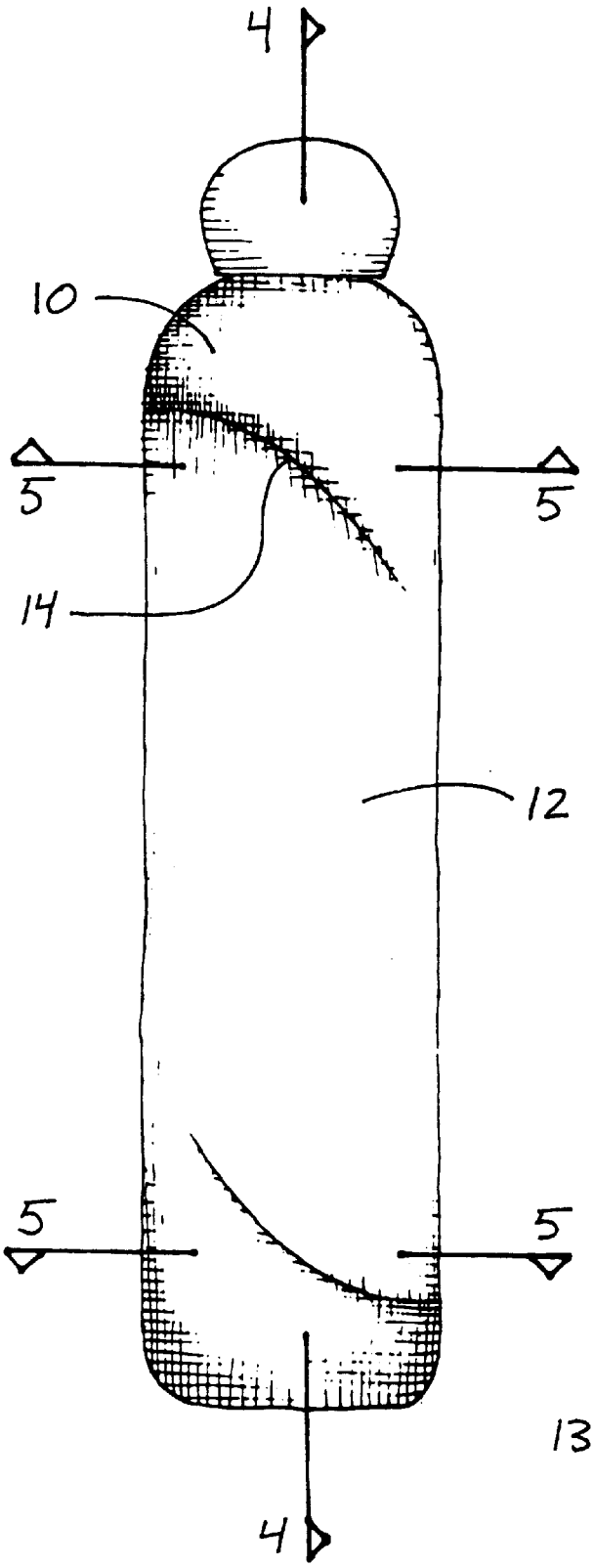
FIG. 3 is a front view of one embodiment of the invention, having section lines 4—4 and 5—5 corresponding to FIG. 4 and FIG. 5, respectively.

FIG. 3 shows a front view of the embodiment detailed in FIG. 2. The finger support 14 is shown extending transversely from the fluid applicating end portion 12 of the fluid applicator and terminating within the central portion 12. Although the finger support 14 is shown in its preferred arcuate or swoosh form, it can be in linear or other forms as long as it extends from the fluid applicating end portion 10 transversely through the central portion 12 and extends outwardly in a manner effective to form a support member for a user's fingers.

Figure 4:
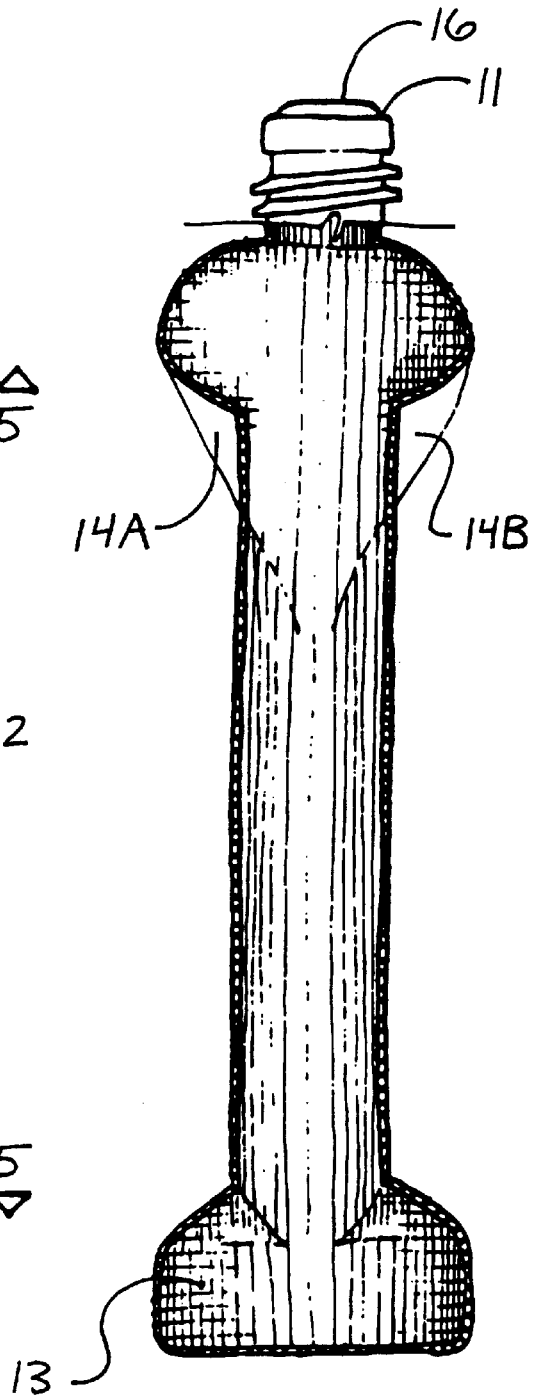
FIG. 4 is a section view taken along line 4—4 of FIG. 3.

As shown in FIG. 4, the finger support is preferably applied on adjacent sides of the applicator as 14A and 14B. In this preferred embodiment, sealed end 13 is shown as having a circular shape. Inserted into the opening 11 is an applicator tip 16.

Figure 5:
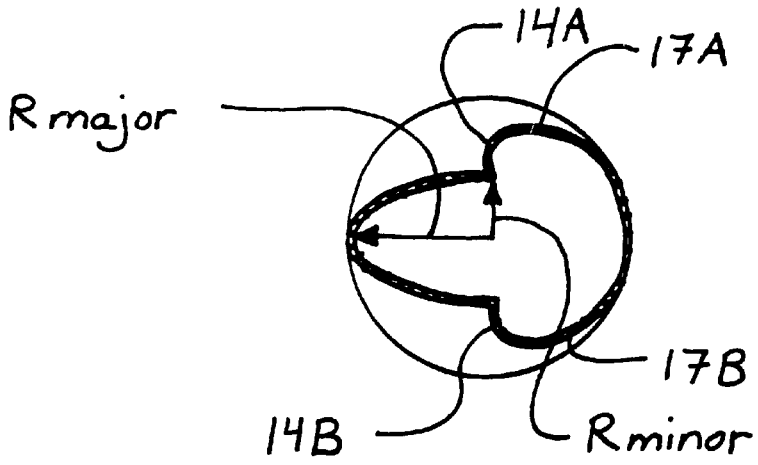
FIG. 5 is a section view taken along line 5—5 of FIG. 3.

As shown in a preferred embodiment in FIG. 5, the central portion is preferably an oval form having a major radius, $R_{major}$, and a minor radius, $R_{minor}$, with a major radius approximating that of the circular shaped sealed end portion. Preferably, the minor radius is between 40% and 80% that of the major radius. Each finger support 14A and 14B preferably has a convex edge 17A and 17B, respectively, which extends outwardly from the minor radius of the oval shape central portion and terminates at the major radius of the oval shaped central portion.

Figure 6:
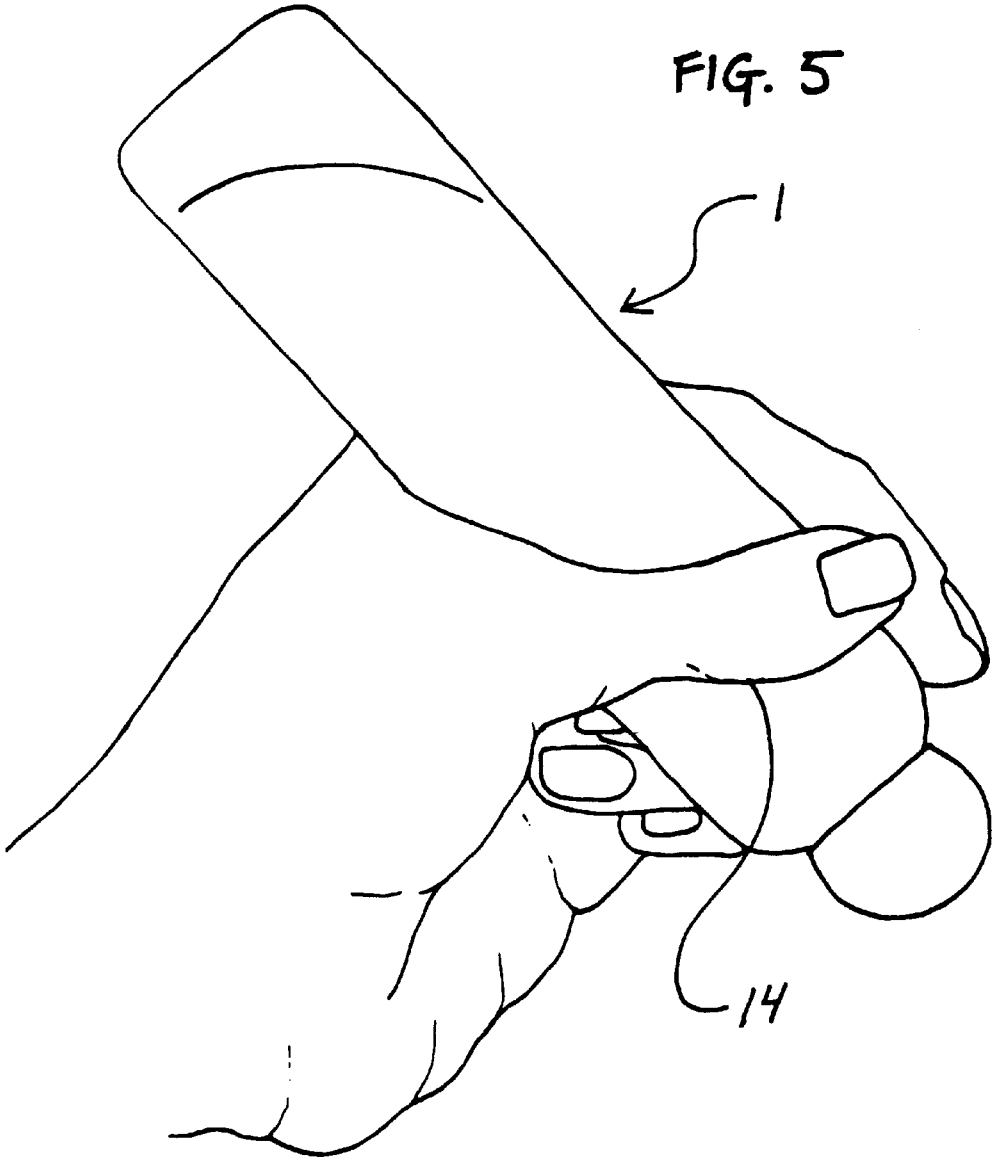
FIG. 6 is a drawing depicting how the fluid applicator of the present invention fits into the hand of a user.

The fluid applicator 1 is designed to be easily and comfortably held by a user as shown in FIG. 6. The finger support 14 is designed so that the thumb and the second finger of a user can rest comfortably against the finger support 14. The first finger can then be used to guide the fluid applicator in applying fluid to a surface. Although the thumb and second finger are shown in FIG. 6 as residing alongside the finger support 14, the finger support protrudes from the central portion to the extent that the applicator bottle can be rotated 180 degrees along its longitudinal axis, and still provide adequate support for the thumb and index finger. In other words, the placement of the first finger along any particular side of the fluid applicator does not matter as long as the finger support extends transversely throughout the central portion and protrudes outwardly from the central portion to provide an abutting support against which a user's fingers can rest.

Figure 7:
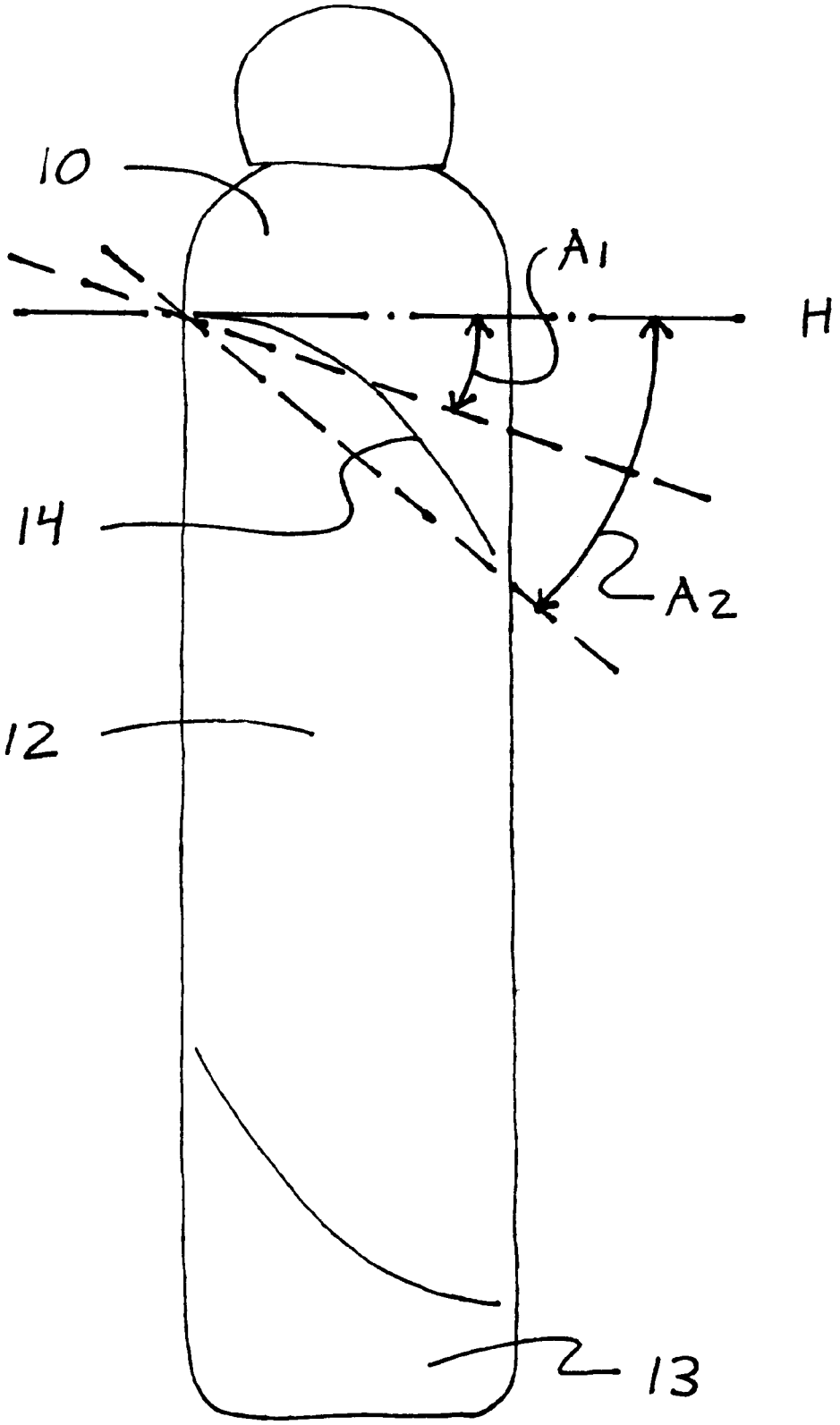
FIG. 7 is a front view describing further details of the finger support which forms a portion of the invention.

The finger support is further described in FIG. 7. In this embodiment, the applicating end portion 10 and the central portion 12 are separated by an imaginary horizontal plane H. From this plane, the finger support 14 can extend transversely through the central portion 12, terminating at either the central portion 12 or the sealed end portion 13 of the fluid applicator. Typically, this will be determined by the length of the central portion 12. For example, if the central portion 12 is relatively long so that a greater quantity of fluid can be held within the applicator, then it is likely that the finger support 14 will terminate at the central portion. If an applicator is desired to have a lesser quantity of fluid, then the finger support 14 can extend through the central portion 12 and terminate at the sealed end 13.

It is preferred that the finger support 14 extend transversely from the applicating end portion at an angle between about 15 degrees and 60 degrees from the plane H running horizontally through the applicating end portion 10 and the central portion 12. In this embodiment, the finger support 14 is shown in its preferred arcuate form. The angle $A_1$, represents about 15 degrees from the plane H, and the angle $A_2$ is an angle about 60 degrees from the plane H.

Figure 8:
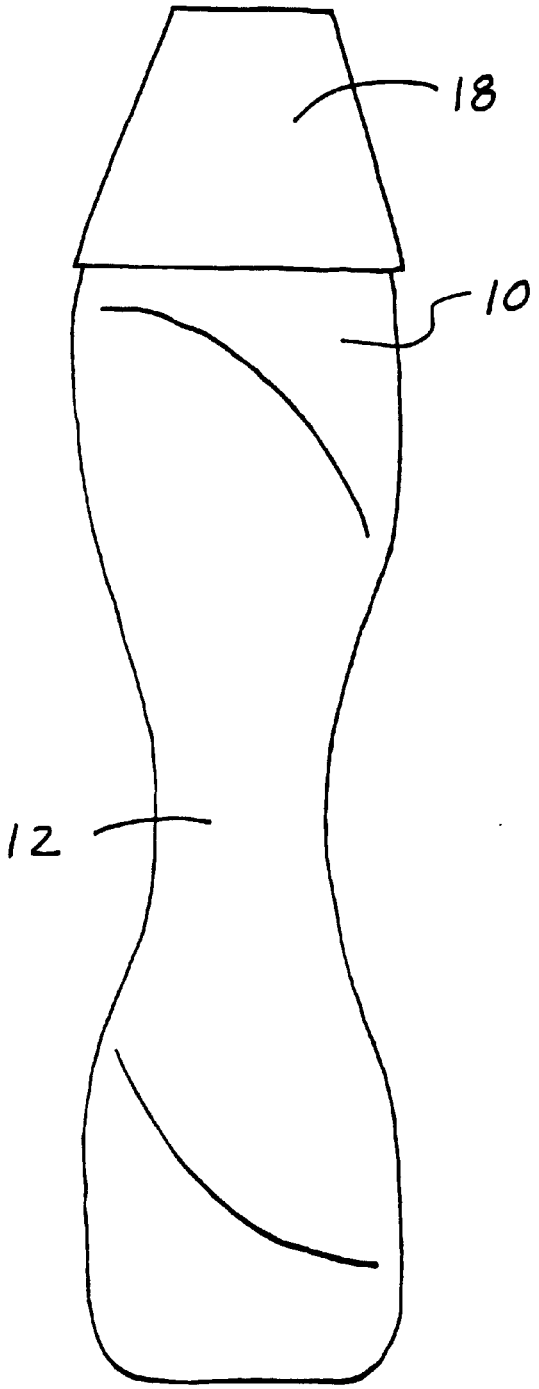
FIG. 8 is a front view of another embodiment of the invention.

FIG. 8 shows an alternative preferred embodiment. In this embodiment, the central portion 12 does not have the same major radial dimension as the applicating end 10. In this embodiment, the major radius of the central portion 12 is less than that of the applicating end 10. Also in this embodiment, a snap top cap 18 is shown.

Figure 9:
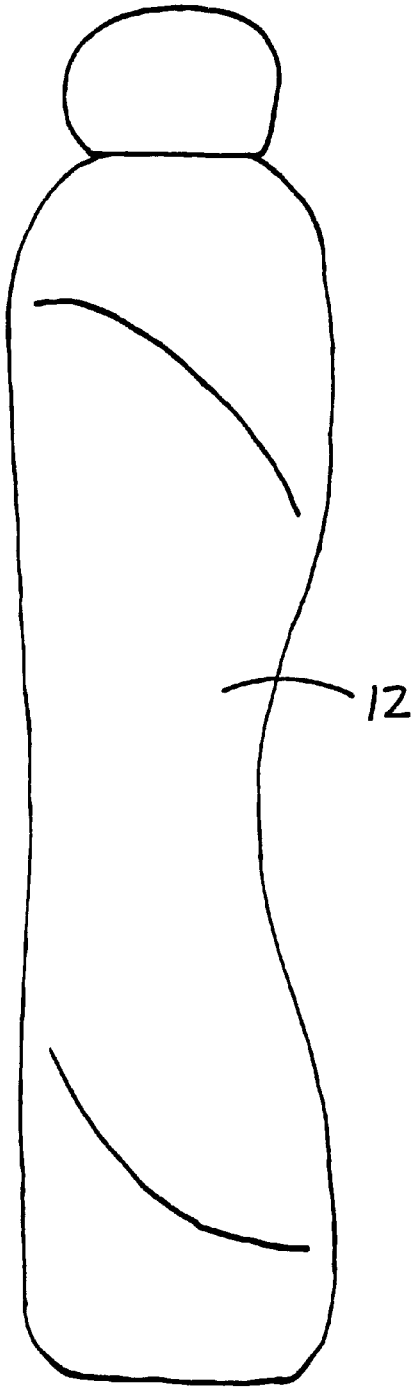
FIG. 9 is a front view of another embodiment of the invention.

FIG. 9 shows another alternative embodiment. In this embodiment, the central portion 12 is an asymmetrical form balanced to rest more comfortably into a user's hand.

It is particularly desired that this invention be used as a Bingo ink dauber. The finger support makes it particularly comfortable for a user in this environment, since resting the thumb and second finger against an ink dauber particularly fits the way one plays Bingo. In addition, the oblong shaped central portion of the applicator is particularly contoured for this use, making daubing more comfortable than ever before. In this particular use, the applicator can be made to accommodate a significant quantity of ink, both 3 and 4 oz. sizes are particularly desirable. Having now fully described this invention, it will be appreciated that those skilled in the art that the invention can be performed within a wide range of shapes and parameters equivalent to what is literally claimed and specifically described herein.

What is claimed is:

1. A fluid applicator comprising:

a circular shaped applicating end portion having an opening for filling and dispensing fluid from the fluid applicator, with the opening containing an applicator tip, the applicator tip being a roller tip, a daubing tip, a marking tip, or a fountain tip;

a central portion connected to the applicating end portion, wherein the central portion has an oval shape having a major radius and a minor radius, with the major radius approximating that of the circular shaped applicating end portion, and the minor radius being between 40% and 80% that of the major radius;

a sealed end portion fused to the central portion; and a finger support extending from the applicating end portion and running through the central portion at an angle between 15 and 60 degrees from a plane running horizontally through the applicating end portion, wherein the finger support is a protrusion having an edge which extends sufficiently outward from the central portion to be effective for supporting a user's fingers during fluid application.

2. The fluid applicator of claim 1, wherein the finger support is a convex edge which extends outwardly from the minor radius of the oval shape central portion and terminates at the major radius of the oval shaped central portion.

3. The fluid applicator of claim 1, wherein the sealed end portion has a flat, closed end region for standing the fluid applicator at an upright position.

4. The fluid applicator of claim 1, wherein the finger support terminates at the central portion.

5. The fluid applicator of claim 1, wherein the finger support extends in an arcuate, transverse direction through the central portion for supporting a user's fingers during fluid application.

* * * * *